US008372333B2

(12) United States Patent
Taber

(10) Patent No.: US 8,372,333 B2
(45) Date of Patent: Feb. 12, 2013

(54) ANGLED PROBE FOR VESSEL

(75) Inventor: Wade Albert Taber, Katy, TX (US)

(73) Assignee: General Electric Company, Schenectady, NY (US)

( * ) Notice: Subject to any disclaimer, the term of this patent is extended or adjusted under 35 U.S.C. 154(b) by 397 days.

(21) Appl. No.: 12/350,543

(22) Filed: Jan. 8, 2009

(65) Prior Publication Data

US 2010/0171245 A1 Jul. 8, 2010

(51) Int. Cl.

| | |
|---|---|
| ***C21B 13/00*** | (2006.01) |
| *C21B 15/00* | (2006.01) |
| *C21B 7/24* | (2006.01) |
| *C21B 3/00* | (2006.01) |

(52) U.S. Cl. ..... 266/44; 266/79; 266/99; 266/275

(58) Field of Classification Search ..... 266/79, 266/275, 99

See application file for complete search history.

(56) References Cited

U.S. PATENT DOCUMENTS

| | | | | |
|---|---|---|---|---|
| 2,397,901 | A | 4/1946 | Zimmerman | |
| 4,134,738 | A * | 1/1979 | Bress et al. | 48/85.2 |
| 4,391,584 | A | 7/1983 | Daniel | |
| 4,776,705 | A | 10/1988 | Najjar et al. | |
| 4,981,088 | A | 1/1991 | Burris | |
| 5,005,986 | A | 4/1991 | Najjar et al. | |
| 5,372,618 | A * | 12/1994 | Andrus, Jr. | 48/87 |
| 6,059,453 | A | 5/2000 | Kempf et al. | |
| 7,036,983 | B2 | 5/2006 | Green et al. | |
| 2001/0024464 | A1 | 9/2001 | Green et al. | |
| 2003/0174756 | A1 | 9/2003 | Groen | |
| 2007/0001352 | A1 * | 1/2007 | Shver | 266/79 |

FOREIGN PATENT DOCUMENTS

GB 2018409 A 10/1979

OTHER PUBLICATIONS

Search Report and Written Opinion from corresponding PCT Application No. PCT/US2009/068409 dated Aug. 21, 2012.

* cited by examiner

*Primary Examiner* — Keith Walker
*Assistant Examiner* — Alexander Polyansky
(74) *Attorney, Agent, or Firm* — Cantor Colburn LLP

(57) ABSTRACT

A vessel comprises a probe oriented downward from an outside surface of the vessel to an inside surface of the vessel. A method of operating a vessel, the vessel comprising a vessel wall having an inside surface and an outside surface, comprises: defining a hole extending through the vessel wall, the hole being oriented at a downward angle from the outside surface to the inside surface; and placing a probe in the hole; and preventing slag buildup around the probe during operation of the vessel.

5 Claims, 2 Drawing Sheets

ANGLED PROBE FOR VESSEL

BACKGROUND OF THE INVENTION

The subject matter disclosed herein relates to a probe for a vessel.

A gasifier is a type of vessel, or reactor, used for partial oxidation of a fossil fuel, such as coal or a heavy fuel oil, to produce energy. A vessel wall of a gasifier may comprise a shell lined on the inside with an insulating refractory lining. The refractory lining may comprise a plurality of layers. Conditions in the vessel may reach well over 700° C. during operation. The gasification process is monitored and regulated using probes or flanges that penetrate the shell and refractory lining. The tip of a probe may be located at or near the hot inner surface of the refractory lining, so as to determine if conditions in the vessel are appropriate.

A probe may be inserted through the vessel wall and refractory lining through a hole, or opening, in the vessel wall and refractory lining that is oriented perpendicular to the vessel wall and the vessel center line. The hole is large enough to accommodate the probe, with additional space to prevent damage to the probe during expansion and contraction of the refractory lining at high temperatures. Different layers of the refractory lining may expand at different rates; the probe may be caught between two differently expanding layers, resulting in breakage of the probe. The extra space in the hole that allows for thermal expansion of the refractory lining may allow slag that is produced in the slagging vessel to flow inside the hole and come in contact with the probe. Slag penetration may cause damage to the refractory lining and corrosion of the probe's protective encasement or sheath. If the protective exterior of a probe is penetrated, any internal wires and materials may be damaged beyond use. Slag may also freeze in the hole, filling the space that allows for thermal expansion of the refractory lining, and causing the probe to break during expansion or contraction of the refractory lining.

There exists a need in the art for a probe configuration for a slagging vessel that will prevent damage to the probe.

BRIEF DESCRIPTION OF THE INVENTION

According to one aspect of the invention, a vessel comprises a probe oriented downward from an outside surface of the vessel to an inside surface of the vessel.

According to another aspect of the invention, a method of operating a vessel, the vessel comprising a vessel wall having an inside surface and an outside surface, comprises defining a hole extending through the vessel wall, the hole being oriented at a downward angle from the outside surface to the inside surface; and placing a probe in the hole; and preventing slag buildup around the probe during operation of the vessel.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

A probe, examples of which may include but are not limited to a thermocouple, a chemical sensor, an optical sensor, or a pressure sensor, inserted in a hole that is oriented downward from the outside of a vessel wall to the inside of a vessel wall reduces slag flow into the hole by the force of gravity. The vessel lining grows upwards and outwards radially during thermal expansion; because the angled hole is oriented in the same direction as the lining growth, the angled hole moves with the lining as it expands and contracts. Therefore, the angled probe requires less additional space to allow for the expansion and contraction of the refractory lining. As the size of the hole in the lining is reduced, the amount of slag that penetrates the hole is also reduced. An angle of about 15 to about 45 degrees from the plane orthogonal to the vessel centerline may be implemented for the angled thermocouple probe in some embodiments. The reduction in the size of the hole is dependent on the penetration angle of the probe. A hole oriented perpendicular to the vessel wall may have a diameter of about 50 mm (2 inches). For an example hole at an angle of 45 degrees, the hole size may be reduced by as much as approximately 12 mm (0.5 inch), yielding an angled hole diameter of approximately 38 mm (1.5 inches), reducing slag fill volume by about 40%.

Figure 1:
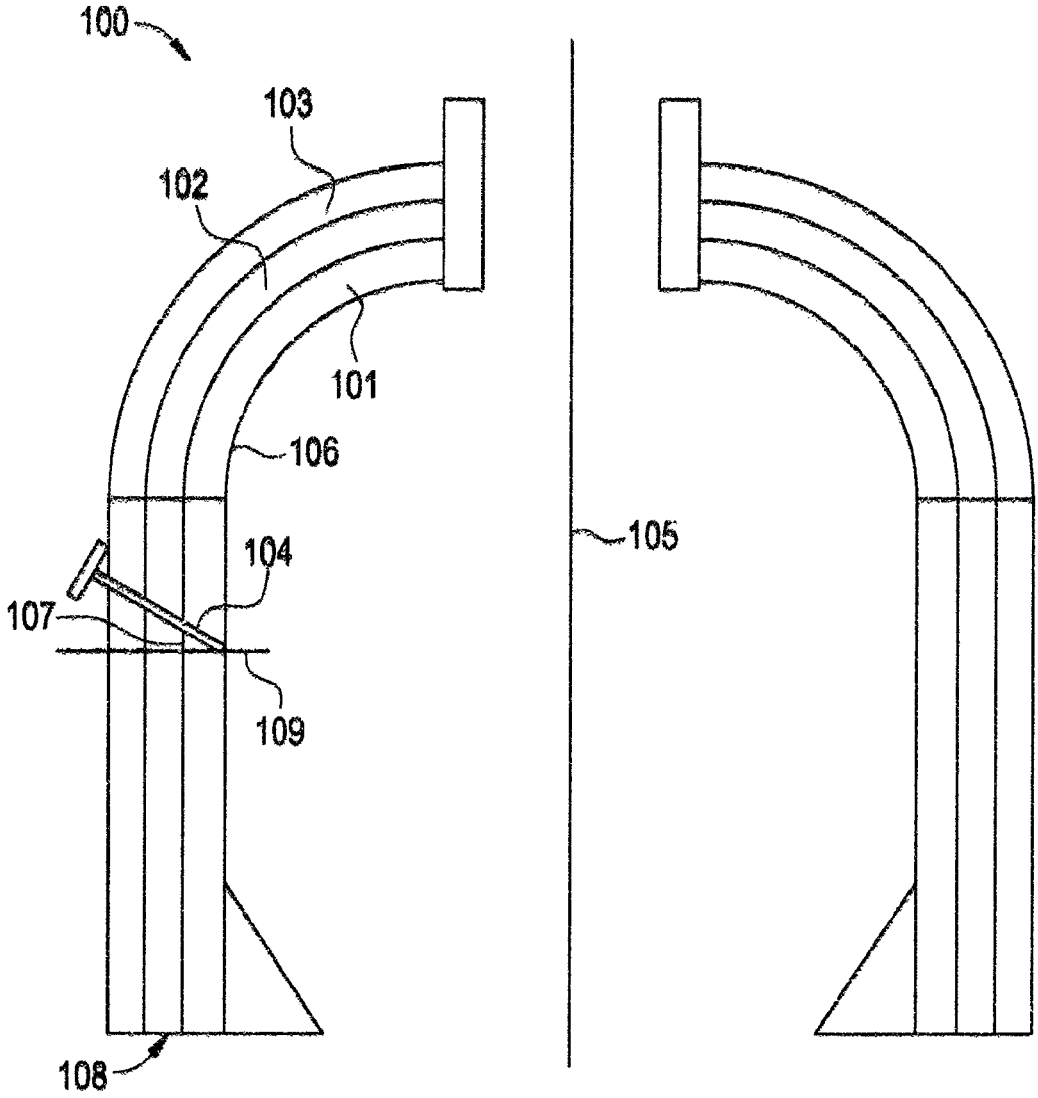
FIG. 1 is an embodiment of a vessel comprising an angled probe.

FIG. 1 shows an embodiment of a vessel 100 with an angled probe. One probe is shown in the embodiment of FIG. 1 for illustrative purposes; a slagging vessel may comprise any appropriate number of probes. The vessel wall 108 comprises three layers: outer shell 103, outer refractory layer 102, and inner refractory layer 101. Although three layers are shown in the embodiment of FIG. 1, a vessel wall may comprise any appropriate number of layers. Probe 104 extends through a hole (shown below in FIG. 2) that is oriented downward from outer shell 103 through the refractory layers 101 and 102 to hot inner surface 106. Angle 107 between the plane 109 orthogonal to the vessel center line 105 and the probe 104 may be about 15 to about 45 degrees in some embodiments. Angle 107 reduces slag flow into the hole, as slag does not flow significantly against gravity.

Angle 107 is oriented in the same direction as the movement of the slagging vessel refractory lining layers 101 and 102 during thermal expansion. Refractory lining layer 101 is at a higher temperature than refractory lining layer 102 during operation of the vessel; therefore, the upward and outward expansion of refractory lining layer 101 may be greater than the expansion of refractory lining layer 102. The angle of angled probe 104 allows angled probe 104 to move with the expansion of the refractory lining layers 101 and 102. Because the angled probe 104 is oriented in the same direction as the movement of the lining, the probe opening may move with the lining as the lining expands and contracts. This reduces the likelihood of breakage of the probe 104 caused by lining layers 101 and 102 expanding differently at high temperatures, extending the life of probe 104.

Figure 2:
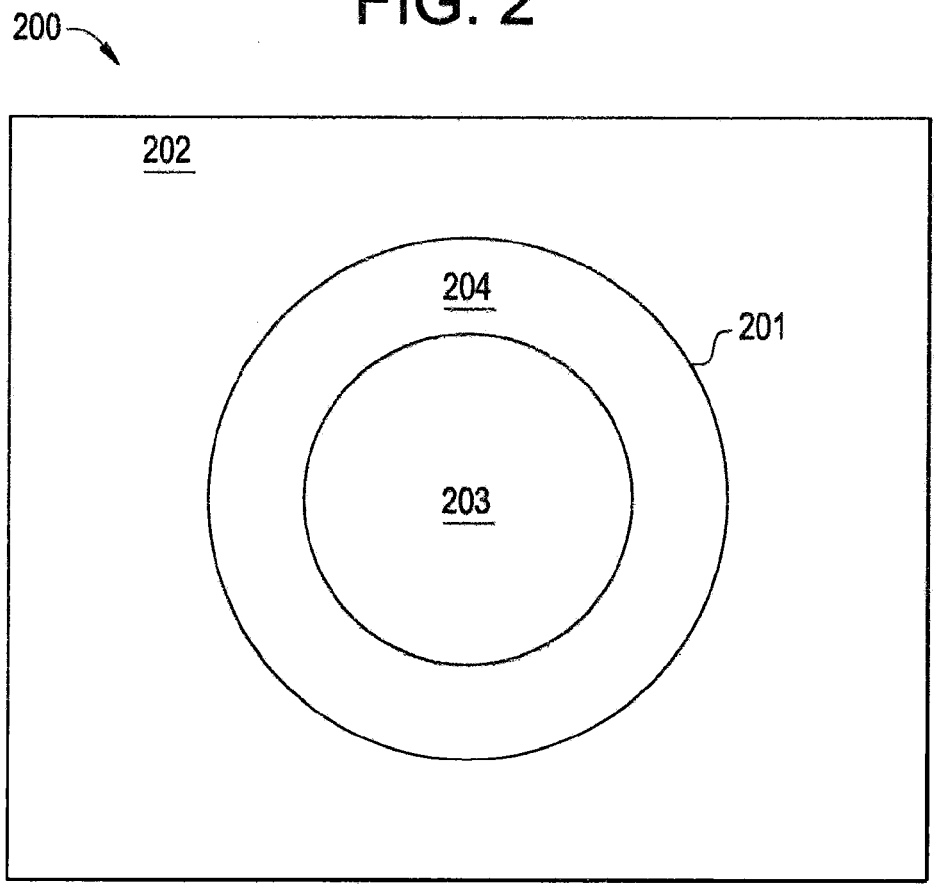
FIG. 2 is an embodiment of a hole in a vessel wall for an angled probe.

Referring to FIG. 2, which shows an embodiment of a hole in a refractory layer of a vessel wall for an angled probe, hole 201 the refractory layer 202 contains probe 203, with extra space 204 to allow for expansion and contraction of refractory layer 202. Additional space 204 may be reduced by about 40% by volume for angled probe 203, as the angle probe moves in the same direction as the refractory layer 202 during thermal expansion. The reduction of additional space 204 reduces the amount of slag that may flow into hole 201.

Reduced slag infiltration into the refractory layers results in reduced damage to the refractory lining and extended life of a probe. Increasing the probe life contributes to increased reliability for the vessel by allowing for accurate monitoring of the conditions inside the vessel. Increased probe life also reduces planned and unplanned maintenance outages and vessel shutdowns, saving costs associated with loss of production and maintenance.

Figure 3:
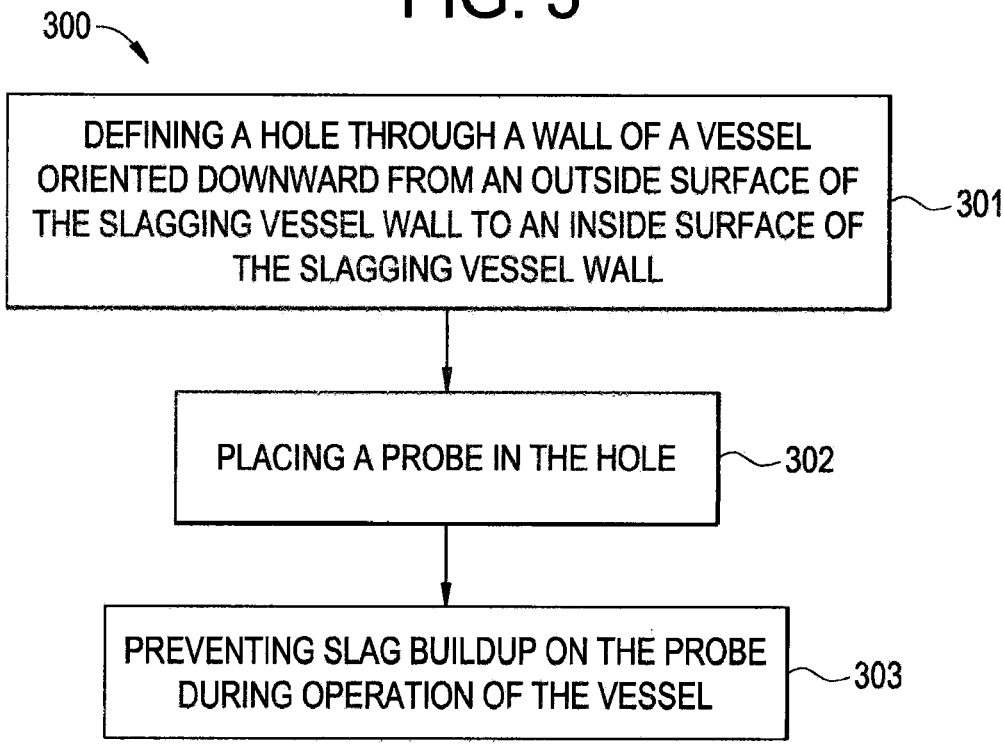
FIG. 3 is an embodiment of a method for producing a vessel comprising an angled probe.

FIG. 3 shows an embodiment of a method 300 for operating a vessel having an angled probe. In block 301, a hole in the vessel wall is defined that is angled downward from the outer surface of the slagging vessel wall to the inner surface of the vessel wall is provided through the vessel wall. In block 302, a probe is placed in the angled hole. The angle of the hole may be about 15 to about 45 degrees from the plane orthogonal to the vessel centerline in some embodiments. In block 303, slag buildup is prevented on the probe during operation of the vessel.

Although an angled probe has been discussed above in the context of a gasifier for illustrative purposes, an angled probe may be incorporated into any type of vessel, examples of which may include, but are not limited to, a slagging vessel, a coal-fired boiler, a solid waste incinerator, a shaft furnace, or a thermal oxidizer.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A method of operating a gasifier vessel comprising a slagging vessel, the gasifier vessel comprising a gasifier vessel wall having an inside surface and an outside surface, the method comprising:

defining a hole extending through the gasifier vessel wall, the hole being oriented at a downward angle from the outside surface to the inside surface, wherein the outside surface of the gasifier vessel wall comprises an outer shell, the inside surface of the gasifier vessel wall comprises an inner refractory layer, and the gasifier vessel wall further comprises an outer refractory layer located between the outer shell and the inner refractory layer;

placing a probe in the hole; and preventing slag buildup around the probe during operation of the gasifier vessel comprising the slagging vessel, wherein the slag buildup in the hole is prevented by the downward angle of the hole through the gasifier vessel wall, and wherein the probe remains fixed in the hole during operation of the gasifier vessel.

2. The method of claim 1, wherein the downward angle is from 15 degrees to 45 degrees from a plane orthogonal to a centerline of the gasifier vessel.

3. The method of claim 1, further comprising moving the hole with the gasifier vessel wall in the direction of thermal expansion of the gasifier vessel wall during operation of the gasifier vessel comprising the slagging vessel.

4. The method of claim 1, wherein the probe in the hole in the gasifier vessel wall comprises a thermocouple.

5. The method of claim 1, wherein an end of the probe is located at the inside surface of the gasifier vessel wall.

* * * * *